United States Patent [19]

Spence

[11] 4,087,879

[45] May 9, 1978

[54] SHAG RUG BRUSHING AND OBJECT RETRIEVING DEVICE

[76] Inventor: Forrest Spence, 300 N. Rampart, Space 145, Orange, Calif. 92668

[21] Appl. No.: 540,135

[22] Filed: Jan. 10, 1975

[51] Int. Cl.[2] ..... A47L 11/40; A47L 13/40

[52] U.S. Cl. ..... 15/142; 209/215

[58] Field of Search ..... 15/142, 159, 171, 183, 15/386, 388, 339; 152/271, 272, 280; 209/215; 56/400.04, 400.21

[56] References Cited

U.S. PATENT DOCUMENTS

| | | | |
|---|---|---|---|
| 937,385 | 10/1909 | Pardridge et al. | 152/271 |
| 1,151,462 | 8/1915 | Haus | 152/272 |
| 1,196,237 | 8/1916 | Holm | 15/183 |
| 1,246,713 | 11/1917 | Calkins | 152/272 |
| 1,630,776 | 5/1927 | Bonawitz | 152/271 |
| 3,232,035 | 2/1966 | Vissers | 15/183 X |
| 3,744,082 | 7/1973 | Marshall | 15/142 X |
| 3,766,588 | 10/1973 | Kopecky | 15/142 |
| 3,852,844 | 12/1974 | Hukuba | 15/142 |

*Primary Examiner*—Christopher K. Moore
*Attorney, Agent, or Firm*—William C. Babcock

[57] ABSTRACT

A wheel-supported shag rug brushing and raking device, which when moved over a shag rug fluffs the long strands of the nap thereof, and concurrently retrieves magnetically attractable objects such as hairpins, bobby pins, and the like. The device is relatively light in weight inasmuch as all or a substantial portion of the components thereof may be injection molded from a suitable polymerized resin. When not in use, the device may be disposed in a position to occupy a minimum of space.

1 Claim, 7 Drawing Figures

FIG. 1
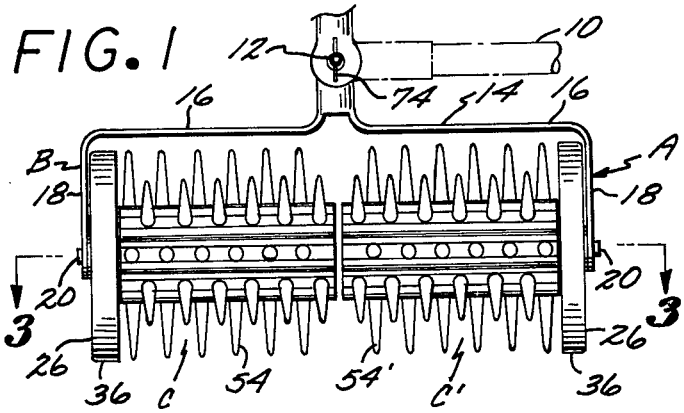
FIG. 2
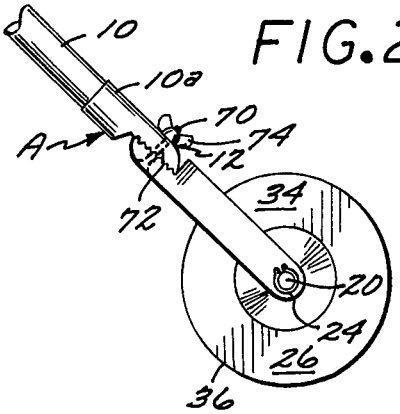
FIG. 3
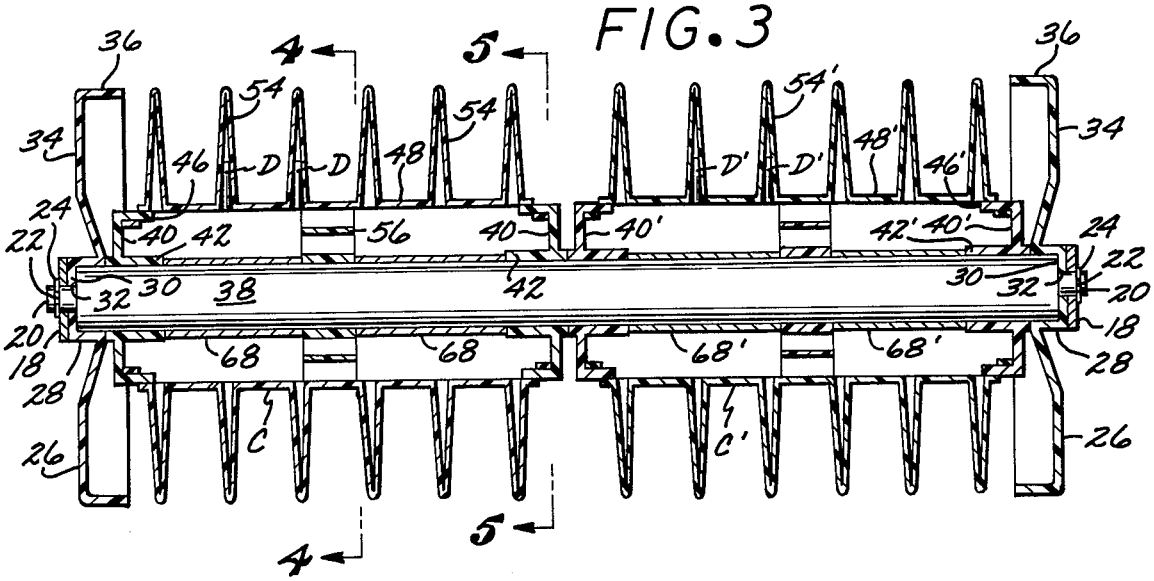
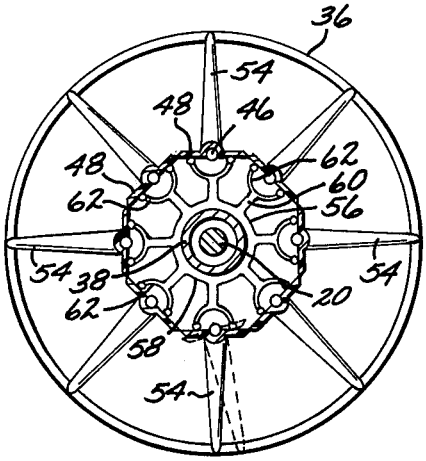
FIG. 4
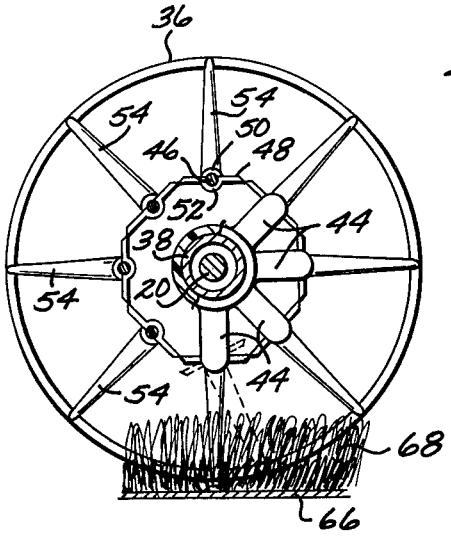
FIG. 5
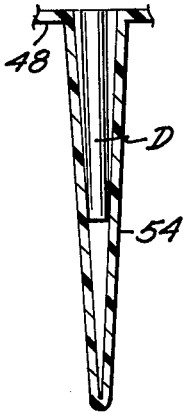
FIG. 6
FIG. 7
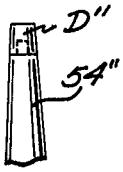

SHAG RUG BRUSHING AND OBJECT RETRIEVING DEVICE

BACKGROUND OF THE INVENTION

1. Field of the Invention

Shag rug brushing and object retrieving device.

2. Description of the Prior Art

In the past few years shag rugs have become increasingly popular as floor coverings. Such rugs, due to the long strands forming the nap thereof, have the disadvantage that the strands become matted and entangled, and also small objects such as bobby pins, hairpins, and the like, drop onto the rug to become concealed within the nap thereof. If such objects are not removed, they will cut the strands of the nap, due to the abrasive action thereof as persons walk over the rug and force the objects into pressure contact with the strands.

Prior to the present invention there has been no lightweight, easily usable device, which when moved over a shag rug will concurrently brush and fluff up the strands thereof, as well as remove small magnetically attractable objects from the rug.

The primary object in devising the present invention is to supply a lightweight device that may be easily and conveniently rolled over a shag rug to brush and fluff the strands of the nap thereof, and concurrently remove small magnetically attractable objects from the nap of the rug to prevent such objects from cutting the strands when brought into pressure contact therewith as occurs when persons walk over the rug.

Another object of the invention is to supply a device in which at least the major portion of the components thereof may be formed by injection molding from a polymerized resin, and as a result the device is not only durable but of light weight and easily moved from room to room as required.

A still further object of the invention is to furnish a device that has a relatively simple mechanical structure, requires a minimum of maintenance attention, and when not in use, may be disposed in a position to occupy a minimum of storage space.

SUMMARY OF THE INVENTION

A shag rug brushing and raking device that concurrently with the use thereof for that purpose, retrieves small magnetically attractable objects such as hairpins, bobby pins, and the like, that tend to remain concealed within the deep pile of the rug. The device includes a first wheel-supported assembly that is moved over the rug by an elongate handle which forms a part thereof. The first assembly serves to rotatably support a second assembly. The second assembly includes at least one pair of longitudinally spaced end cap retainers that are rotatably supported on a horizontal shaft forming a part of the first assembly.

The end cap retainers have a number of longitudinally aligned and circumferentially spaced pins thereon which extend towards one another. The pins pivotally support a number of strips in side-by-side relationship to encircle the shaft. The strips have a number of prongs extending outwardly therefrom that are of such length as to frictionally engage the nap of the rug when in their lowermost positions. As the prongs so engage the nap of the rug, the long strands thereof are brushed and raked. The strips and prongs tend to be held in a first angular relationship by spring means forming a part of the second assembly.

However, if prongs when in the lowermost position engage strands which are entangled to a degree that they are not easily separated, the strip that supports the prongs may pivot against the bias of the spring means to a second relationship with the balance of the strip.

Prongs on the strip when the latter is in a second relationship are angularly disposed relative to the rug and may slip out of engagement with the entangled strands without damaging the latter. The prongs, in addition to serving the above described function of brushing and raking the rug, also act as carriers for permanent magnetic means that retrieve small magnetically attractable objects such as hairpins or the like that would otherwise remain buried within the deep pile of the rug.

The handle on the first assembly is pivotally adjustable relative thereto, and when the device is not in use the handle may be pivoted to a position substantially parallel to the shaft to permit the device to be stored in a minimum of space.

The device above described is, in the main, capable of having the components thereof injection molded from a suitable polymerized resin, such as polyethylene or polyproplyene. By the use of such injection molded components, the weight of the device is minimized to permit the easy carrying thereof from one room to another for use in brushing and raking a shag rug, as well as retrieving magnetically retractable objects therefrom.

BRIEF DESCRIPTION OF THE DRAWING

FIG. 1 is a front elevational view of the device;

FIG. 2 is an end elevational view of the device;

FIG. 3 is a longitudinal cross-sectional view of the device, taken on the line 3—3 of FIG. 1;

FIG. 4 is a transverse cross-sectional view of the device, taken on the line 4—4 of FIG. 3;

FIG. 5 is a second transverse cross-sectional view of the device, taken on the line 5—5 of FIG. 3;

FIG. 6 is an enlarged fragmentary cross-sectional view of a first form of the prongs, illustrating a first form of permanent magnet included as a part thereof; and FIG. 7 is an end elevational view of a second form of prongs, illustrating an alternate structure of mounting a second form of permanent magnet thereon.

DESCRIPTION OF THE PREFERRED EMBODIMENT

The shag rug brush and magnetically attractable object retrieving device A is shown in FIGS. 1 and 2. The device A includes a movable wheel-supported assembly B that serves as a mounting for a freely rotatable brush and object-retrieving assembly C.

Movable assembly B, as may be seen in FIGS. 1 and 2, includes an elongate handle 10 which has a first end **10*a* on which a pivotal adjustment 12 is mounted which is connected to a bale 14**.

Bale 14 includes a cross piece 16 which has two apertured arms 18 extending outwardly from the ends thereof. A rigid axle 20 extends between arms 18 and projects outwardly short distances therefrom. Transverse circular grooves 22 are formed in the projecting portions of axle 20. These grooves 22 are engaged by resilient rings 24 to prevent arms 18 from becoming disengaged from axle 20. Two wheels 26 are rotatably supported on axle 20 inwardly from arms 18, as may best be seen in FIG. 3.

Each wheel 26 includes a cup-shaped hub 28 that is provided with an end piece 30 in which a bore 32 is formed which rotatably engages axle 20. A circular web 34 extends outwardly from each hub 28. Each web 34, on the outer periphery thereof, develops into a rim 36, as best seen in FIG. 3. The cup-shaped hubs 28 rotatably engage a tubular shaft 38 and serve to rotatably support the latter, with the axle 20 and shaft 38 being in concentrically disposed relationship.

The invention is illustrated as having two of the assemblies C and C′ that are identical mounted on the shaft 38. Should it be desired, a single assembly C may be mounted on shaft 38. The advantage of using the two assemblies C and C′ is that a greater width of the shag rug (not shown) may be contacted by a single movement of the device A thereover.

The assemblies C and C′ are identical in structure, and only the assembly C will be described in detail herein. The assembly C includes two end cap retainers 40 that are mounted on shaft 38 and longitudinally spaced from one another. Each retainer 40 includes a tubular sleeve 42 rotatably supported on shaft 38. Each tubular sleeve 42 has a number of circumferentially spaced, radially extending arms 44 secured thereto. The two retainers 40 in assembly C have a number of pins 46 supported from the arms 44, with the pins on the two retainers being longitudinally aligned and extending towards one another, as may be seen in FIG. 3

Assembly C includes a number of elongate strips 48 that have longitudinally extending, outwardly projecting semi-circular center portions 50, and inwardly extending end portions 52. The portions 50 and 52 cooperatively define longitudinally extending openings that are pivotally engaged by the pins 46. Pins 46 serve to pivotally support the strips 48 in an angular first relationship with one another as shown in FIGS. 4 and 5, and with the longitudinal edges of the strips being disposed adjacent to one another. Each of the strips 48 has a number of longitudinally spaced, tapered prongs 54 projecting outwardly therefrom. The prongs 54 are illustrated in FIG. 6 as being hollow and serving as a housing for permanent magnets D.

Assembly C also includes a spring unit 56. The spring unit 56 includes a tubular hub 58 that is rotatably mounted on shaft 38 in a centrally disposed position between end cap retainers 40. Hub 58 has the same number of circumferentially spaced resilient arms 60 projecting outwardly therefrom as there are strips 48. Each arm 60 has two resilient, angularly disposed legs 62 at the outer end thereof which pressure contact the interior surface of one of the strips 48. The legs 62 tend at all times to maintain the strips 48 and prongs 54 in the first angular relationship shown in FIGS. 5 and 5.

The prongs 54 are of such length relative to the wheels 26 that they frictionally engage the strands 64 of the nap of the shag rug 66 as the device A is rolled thereover. As the prongs 54 so frictionally contact the strands 64, the assembly C is rotated on shaft 38. Such frictional contact of the prongs 54 is achieved when the prongs are in their lowermost position.

Should prongs 54 when in the lowermost position engage matted strands 64 that are so entangled they cannot be readily separated, the prongs 54 and strip 48 on which they are mounted may pivot to a second relationship as shown in phantom line in FIG. 4, due to temporary deformation of the arm 60 and legs 62 associated therewith. The prongs 54 in the second relationship are angularly disposed relative to the matted strands 64 and may slide therefrom without tearing or damaging the strands. As soon as the prongs 54 separate from matted strands 64, the spring unit 56 returns the prongs and the strip 48 on which they are mounted to the first relationship, with the balance of the strips being positioned as shown in solid line in FIG. 5. Two tubular spacers 68 are mounted on shaft 38 and serve to maintain spring unit 56 in a centered position thereon. The assemblies C and C′ are rotatably supported end-to-end on shaft 38, as can be seen in FIG. 3, with the assembly C′ serving the same function as that of assembly C.

An alternate prong structure 54′ is shown in FIG. 7 in which a magnet D″ is mounted on the end portion of the prong rather than in the interior thereof as previously described. The magnets D and D″ when the assembly C rotates as the device A moves over the rug 66 serve to retrieve small magnetically attractable objects thereto such as hairpins, bobbie pins and the like, that would otherwise remain concealed by being covered with the strands 64. Persons walking on objects such as hairpins, bobbie pins, or the like (not shown) concealed by the strands 64 force the strands into pressure contact with the objects. Such pressure contact, if continued for a prolonged period of time, will result in the strands being cut or damaged. Accordingly, it is highly desirable that such objects be removed from the strands 64 concurrently with the strands being brushed by the rotating assemblies C and C′ as the device A is rolled thereover by a user who grasps the handle 10 and manipulates the device.

The pivotal adjustment 12 includes a threaded stud bolt 70 that projects from bale 14 and extends through an opening 72 in first handle end **10*a*. Bolt 70 is engaged by a thumb screw 74. The adjacent faces of the first end 10*a* of the handle and bail 14 have serrations 76 thereon which interlock when the thumb screw 74 is tightened to prevent the handle 10 from pivoting relative to bale 14. In FIG. 1 a second position of the handle 10** is shown in phantom line, which is the position that the handle will occupy when it is desired to store the device A in a minimum of space.

The components of the invention previously described may be injection molded from a polymerized resin such as polyethylene or polypropylene and hence is relatively light in weight as well as being strong and durable.

The use and operation of the invention has been described previously in detail and need not be repeated.

I claim:

1. A shag rug brushing and ferrous metal retrieving element that includes:

a. an elongate strip;

b. means on the ends of said strip that define a pair or longitudinally spaced and longitudinally aligned openings;

c. a plurality of longitudinally spaced prongs that extend outwardly from said strip; and d. a plurality of permanent magnets, with each of said magnets mounted in a free end of one of said prongs.

* * * * *